United States Patent [19]

Lahr

[11] 3,952,156

[45] Apr. 20, 1976

[54] SIGNAL PROCESSING SYSTEM

[75] Inventor: Roy J. Lahr, Sierra Madre, Calif.

[73] Assignee: Xerox Corporation, Stamford, Conn.

[22] Filed: Sept. 7, 1972

[21] Appl. No.: 286,981

[52] U.S. Cl. ..... 179/1 GQ; 179/1 VL; 338/90; 338/128; 338/137

[51] Int. Cl.[2] ..... H04R 5/00; H01C 10/04

[58] Field of Search ..... 179/1 GQ, 1 VL, 1 G, 179/100.1 TD; 338/72, 73, 74, 90, 96, 119, 128, 137; 178/18, 19

[56] References Cited

UNITED STATES PATENTS

| | | | |
|---|---|---|---|
| 2,182,192 | 12/1939 | Becker | 179/1 VL |
| 3,082,295 | 3/1963 | Marsov | 179/1 G |
| 3,110,769 | 11/1963 | Bertram | 179/100.1 TD |
| 3,629,775 | 12/1971 | Kindred | 179/1 VL |
| 3,662,313 | 5/1972 | Komatsu | 179/1 VL |
| 3,663,755 | 5/1972 | Lace | 179/1 VL |
| 3,701,963 | 10/1972 | Kasazima | 338/90 |
| 3,739,316 | 6/1973 | Tokubo | 338/128 |
| 3,830,978 | 8/1974 | Odagi | 179/1 GQ |

OTHER PUBLICATIONS

A Stereo Compatibility Translator, by Honig Audio Magazine, Aug., 1958.

*Primary Examiner*—Douglas W. Olms
*Attorney, Agent, or Firm*—John E. Beck; Terry J. Anderson; Leonard Zalman

[57] ABSTRACT

A system for processing a plurality of audio signals to generate binaural output signals. The signal processor has a manually operated spatial position control which provides a correspondence between movement of the control and the binaural perception of movement by a listener at a listening position within an audio signal space. The spatial position control is essentially an electric circuit analog of a particular audio signal space, with means for obtaining variable binaural output signals from the circuit to simulate movement of the listening position in the signal space. One embodiment of the position control includes a mechanical linkage to a plurality of series ring connected potentiometers. The variable outputs from the wiper arms of the potentiometers are combined to produce the desired binaural output signals. The perceived orientation of the listening position in the audio signal space may be changed by selective combinations of potentiometer outputs. Another embodiment utilizes an electrical resistance surface as the analog of the original audio signal space. A probe with spaced apart contacts picks up the binaural output signals from the desired position on the resistance surface, orientation changes being effected by rotating the probe.

8 Claims, 5 Drawing Figures

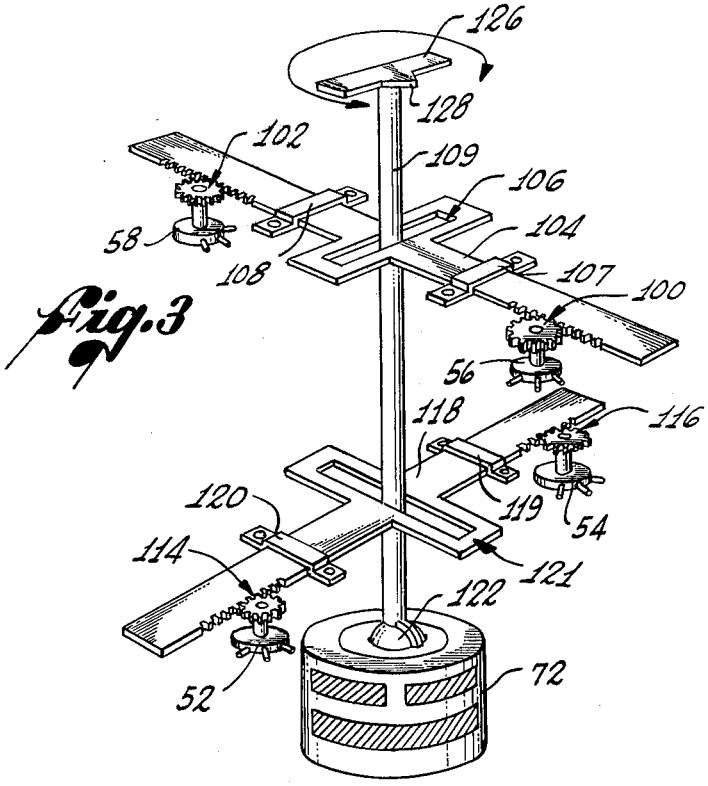
Fig. 3
Fig. 4
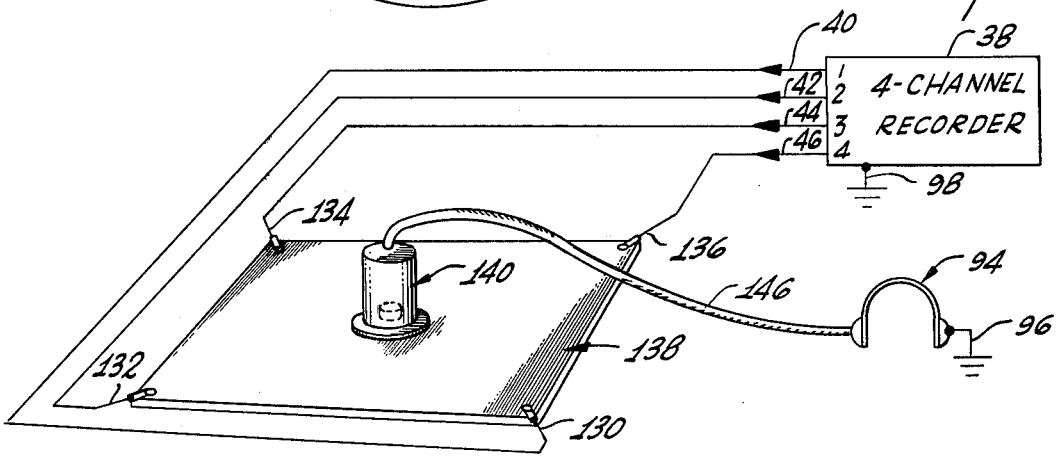
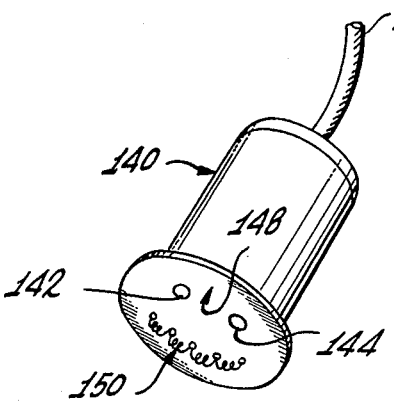
Fig. 5

SIGNAL PROCESSING SYSTEM

BACKGROUND OF THE INVENTION

1. Field of the Invention

The present invention relates generally to signal processing systems and, more particularly, to a system for generating binaural output signals in which there is a correspondence between manipulation of a physical position control and the binaural perception of movement of a listening position within an audio signal space.

2. Description of the Prior Art

The binaural perception of spatial position, or the auditory perception of direction and distance of sounds, has long been known and many systems have been devised to record audio signals in such a manner as to preserve that perception when the recording is played back. Typically, when a recording is made, a plurality of audio transducers, or microphones, are employed and the audio signals from the microphones are simultaneously recorded on separate channels. The recorded multiple channels are then played back through a mixer and combined to produce two channels which are ultimately recorded as binaural sound. Generally, the multi-channel signals may be mixed to preserve the original spatial positions of the sound or adjusted to enhance some aspect of the recorded sound. The proper adjustment of the mixer controls to produce the desired result is very difficult, however, and is generally left to professional audio engineers or technicians.

In some recording applications, there has been a need to selectively enhance portions of the recorded material. For example, in transcribing a conference with numerous participants, it may be desirable to focus on only one of the speakers at a time. However, even with multi-channel recording, there have been no multi-channel signal playback and processing systems which could be relatively simply and easily utilized by relatively unskilled persons to effect such selective enhancement. The present invention provides a unique solution to the latter problem.

SUMMARY OF THE INVENTION

The present invention provides a signal processing system in which manual movement of a physical position control produces corresponding perceived movements in the spatial listening position produced by binaural audio signals. The apparent listening position within an audio signal space may then be easily and quickly moved to enhance the sound level at a desired position in the space.

In the system of the invention, a plurality of audio transducers, such as microphones, are positioned within an audio signal space and audio signals picked up by the microphones as separate channel signals are, preferably, simultaneously recorded. The reproduced channel signals are then fed to a spatial position control which is essentially an electrical circuit analog of the original audio signal space. Manually manipulated variable binaural signal outputs from the circuit analog produce the effect of moving the apparent listening position within the audio signal space.

In a presently preferred embodiment of the invention, the circuit analog is in the form of a number of potentiometers connected in an electrical series ring, or lattice network, providing varying distribution of channel signals around the potentiometer lattice. The binaural output signals are then taken from the wiper arms of the potentiometers. The wiper arms are mechanically interconnected for simultaneous dependent motion by a manually operable control device.

The signals on the wiper arms of the potentiometers are electrically combined to form a pair of binaural output signals which are preferably fed to a pair of binaural headphones, although other audio reproducing devices, such as speakers, may be used with some diminished binaural effect. The mechanical linkages of the control device to the potentiometer wiper arms are arranged such that movement of the control device in a particular direction produces the binaural perception of moving the listening position in a corresponding direction. Thus, the listener can effectively change the apparent listening position within the audio signal space by simply manipulating the control device. The signals on the wiper arms are connected in selectable combinations to produce the effect of changing the perceived orientation of the listening position; that is, the direction in which the listener appears to be facing within the simulated audio signal space.

In an alternate embodiment of the invention, the circuit analog is produced by electrically connecting the multi-channel signals to the edges of a surface having uniform electrical resistance, such as resistance paper, thereby producing distributions of the channel signals across the resistance surface. A probe having a pair of spaced apart electrical contacts picks up the distributed channel signals at two spaced points on the resistance surface and provides these signals as binaural output. As with the potentiometers, moving the probe over the surface of the resistance paper produces the binaural audio effect of moving the listening position in the same direction. The orientation perception may be changed by rotating the probe.

Hence, the signal processing system of the present invention permits the perceived binaural spatial position of a listener to be moved around in a simulated audio signal space by means of the simple manipulation of a manual control in which direction of movement of the control itself produces a corresponding perception of movement of the listening position in the same direction.

BRIEF DESCRIPTION OF THE DRAWINGS

FIG. 3 is a perspective view of the mechanical linkages for a control device suitable for embodying the system of FIG. 2, the electrical interconnection of the potentiometers being eliminated for clarity;

FIG. 4 is a combined block diagram and perspective view of a second embodiment of the invention; and FIG. 5 is a perspective view of the bottom of the probe utilized with the second embodiment of the invention illustrated in FIG. 4.

DESCRIPTION OF THE PREFERRED EMBODIMENT

Figures 1, 2:
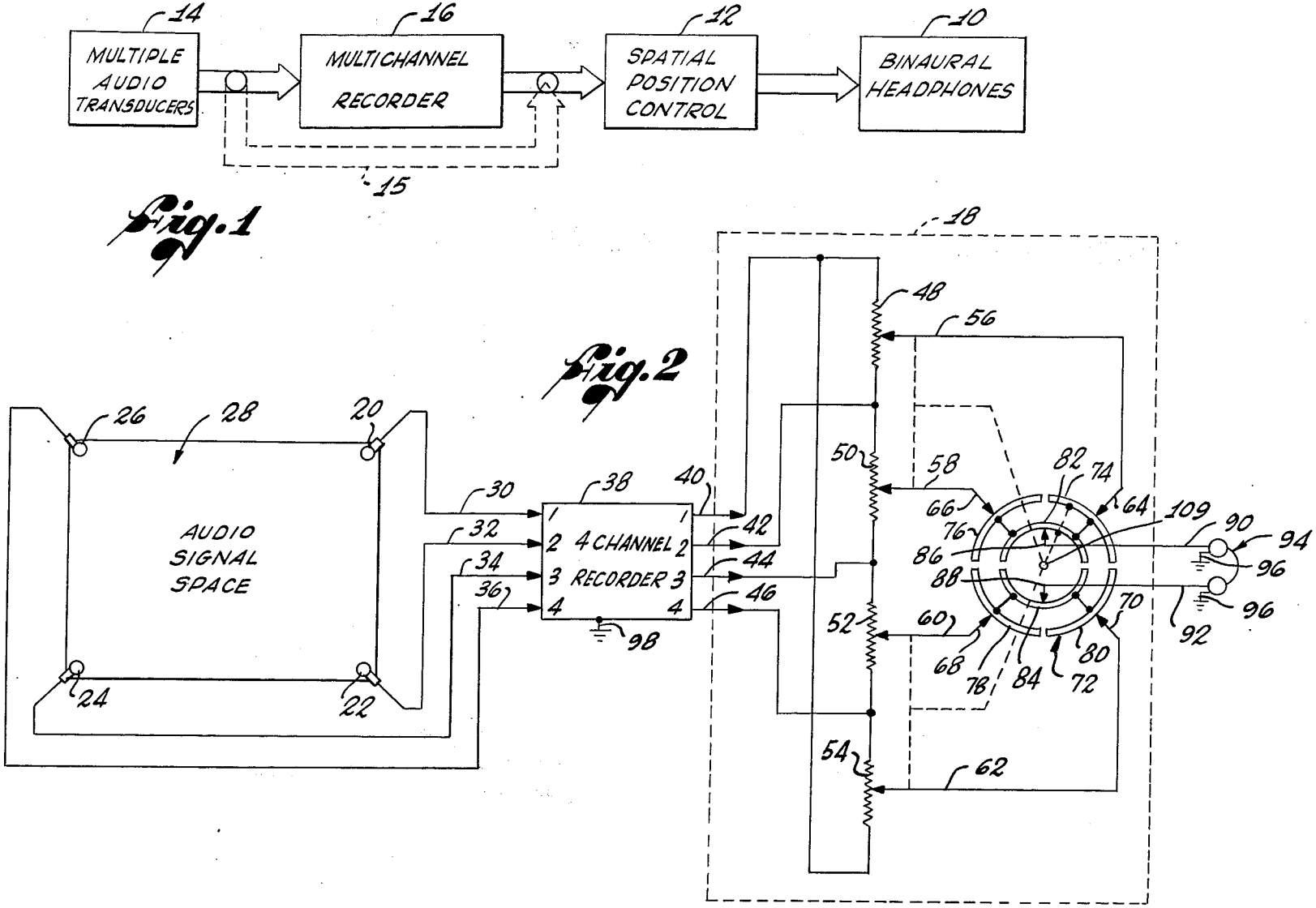
FIG. 1 is a block diagram of the signal processing system of the present invention.
FIG. 2 is a combined block diagram and electrical schematic of a system in accordance with the invention and illustrating the electrical interconnection of one embodiment of a spatial position control.

Turning now to the drawings, the basic concept of the signal processing system of the invention is best illustrated by the block diagram of FIG. 1. As is well known, in binaural sound reproduction, a listener can perceive the spatial position from which a sound eminates. While any sound reproducing device may be utilized, the perception of spatial position is best accomplished by using a pair of binaural headphones 10. In the system of the invention, the listener not only hears the sounds eminating from various points within a simulated audio signal space, but the apparent listening position can be physically moved within the audio signal space by means of a spatial position control 12.

Thus, the listener can effectively move his listening position to a more advantageous position if he wishes to listen to a particular desired sound. As will hereinafter be discussed in greater detail, the spatial position control 12 includes a mechanical device in which manual movement of the device produces a corresponding perception of movement of the listening position within the audio signal space. Therefore, the listening position can be quickly and easily changed by simple manipulation of a control device in the direction of the desired listening position.

The audio signals which are fed to the spatial position control 12 are derived from multiple audio transducers 14 placed in the audio signal space. The audio signals from the transducers may be fed directly to the spatial position control 12 as shown by the phantom line 15, but are preferably first recorded on a multi-channel recorder 16 so that the signals are preserved for processing in any of a variety of ways to obtain different audio effects.

It should be appreciated that the number of audio channels required and the placement of the audio pickups 14 within the audio signal space is dependent on the type of spatial position control 12 utilized. One presently preferred embodiment of the system of the invention is illustrated in FIG. 2. In this embodiment, four audio channels are provided and the configuration of a position control 18 is such that the proper correspondence between physical movement of the control and perceived position changes is accomplished by placing four microphones 20, 22, 24 and 26 at the four corners of an audio signal space 28, which may be a rectangularly shaped room or other similar space. The electrical outputs of the microphones 20, 22, 24 and 26 are fed to the four channel inputs 30, 32, 34 and 36, respectively, of a 4-channel recorder 38. The recorder 38 is preferably a tape recorder capable of recording four channels simultaneously.

When the recorded audio signals are played back, the channel outputs 40, 42, 44 and 46 are connected to the spatial position control 18 which is essentially an electrical circuit analog of the audio signal space 28. In the illustrated embodiment, the outputs 40, 42, 44 and 46 are connected to the outer terminals of four potentiometers 48, 50, 52 and 54, respectively, which are connected together in a lattice network, or in a series connection forming an electrical ring.

Thus, each of the channel signals is essentially connected to all four of the potentiometers 48, 50, 52 and 54 in varying degrees of signal intensity. The wiper arms 56, 58, 60 and 62 of the potentiometers 48, 50, 52 and 54, respectively, are connected to terminals 64, 66, 68 and 70 of an orientation switch 72. The terminals 64, 66, 68 and 70 contact rotatable sliding switch segments 74, 76, 78 and 80. Parts of segments 74, 76 and 78, 80 are connected in common to semi-circular switch segments 82 and 84. Output terminals 86, 88 in contact with the switch segments 82 and 84, respectively, connect the output signals through lines 90, 92 to a pair of binaural headphones 94. The electrical circuits through the resistance lattice and binaural headphones 94 are completed through ground terminals 96 on the headphones and a ground terminal 98 on the recorder 38.

Hence, the signals appearing at the wiper arms 56, 58, 60 and 62 of the potentiometers 48, 50, 52 and 54 are connected in pairs to generate two common output signals which drive the binaural headphones 94. The wiper arms 56, 58 and 60, 62 may be connected in a number of different pairs by rotating the orientation switch 72 which has the perceptive effect of rotating the listening position in the audio signal space 28.

In the embodiment shown in FIG. 2, the wiper arms 56, 58 and 60, 62 are adjusted in pairs. Thus, wiper arms 56 and 58 are simultaneously movable as a pair and wiper arms 60 and 62 are likewise simultaneously movable as a pair, independent of the first pair.

In order to cause the adjustment of the wiper arms 56, 58 and 60, 62 so that the physical movement will correspond with the perceived movement within the audio signal space 28, the mechanical control column configuration shown in FIG. 3 is used. The electrical connections to the potentiometers 48, 50, 52 and 54 are now shown in FIG. 3 in order to best illustrate the mechanical features of the control column. In this configuration, the pair of potentiometers 56 and 58 are driven in common by rack and pinion assemblies 100 and 102 at either end of an elongated bar 104 which has a centrally located slotted yoke 106. The bar 104 is slidably mounted within a pair of brackets 107 and 108. A control column 109 is slidably mounted within the slotted yoke 106 and pivotal movement of the control column 109 in the direction of the longitudinal axis of the bar 104 causes the bar to move, rotating the potentiometers 48 and 50.

Similarly, the other pair of potentiometers 52 and 54 are commonly rotated by means of rack and pinion assemblies 114 and 116 at either end of a second elongated bar 118. The bar 118 is also slidably mounted within a pair of brackets 119, 120. The bar 118 is provided with a centrally located slotted yoke 121 again with the control column 109 being movable within the slot. The bars 104 and 118 are mounted with their longitudinal axis at right angles to each other so that the bars may be moved independently of each other or together in the well known manner of the control column technique.

The lower end of the control column 109 is connected by means of a pivotal universal joint 122 to the orientation switch 72. The control column 109 is keyed to the orientation switch 72 so that rotation of the column in turn rotates the orientation switch. The control column 109 is then preferably supplied with a handle 126 with an index arrow 128 to indicate relative physical orientation.

In operating the control mechanism 18, the control column 109 is generally moved in the direction of the desired listening position. The channel signals on the outputs 440, 42, 44 and 46 of the recorder 38 are connected to the appropriate potentiometers 48, 50, 52 and 54 so that moving the control column 109 has the desired auditory effect. The connections are made so that particular outputs (40, 42, 44 or 46) are connected to the potentiometers in the same channel sequence as the microphones are arranged in the audio signal space 28. The potentiometer lattice may then be considered as substantially an electronic analog of the audio signal space 28 when the microphones 20, 22, 24 and 26 are evenly spaced and the potentiometers 48, 50, 52 and 54 are of the same resistance value. It should be appreciated that circuit analogs of differently shaped audio signal spaces or different transducer placements may be possible by varying the resistances or interconnection of the potentiometers.

An alternate embodiment of the spatial position control 12 of FIG. 1 is illustrated in FIG. 4. In this embodiment, the outputs 40, 42, 44 and 46 of the 4-channel recorder 38 are connected to the four corner terminals 130, 132, 134 and 136, respectively, of a rectangular surface 138 having uniform electrical resistance characteristics. The shape of the resistance surface 138 corresponds to the shape of the audio signal space 28, and the terminals 130, 132, 134 and 136 correspond to the placement of the microphones 20, 22, 24 and 26 within the signal space 28. Again, the resistance surface 138 and the terminals 130, 132, 134 and 136 produce, substantially, an electrical analog of the original audio signal space 28.

In the embodiment of FIG. 4, a position controlling probe 140 is provided with two spaced apart contacts 142, 144 (FIG. 5) which pick up the distributed signals from the outputs 40, 42, 44 and 46 of the recorder 38 and conduct them through a cable 146 to the binaural headphones 94. Again, the circuit is completed through the ground terminal 96 on the headphones to the ground terminal 98 on the recorder 38.

The spacing of the probe contacts 142 and 144 simulates the spacing between the ears of a listener and, by turning the probe 140 to change the position of the contacts 142 and 144 on the resistance surface 138, the apparent orientation of the perceived listening position can be changed. It should be appreciated that there is a rather high electrical loss in the resistance surface 138 so that the probe 140 may have to be provided with auxiliary amplifiers (not shown) which are well known in the art.

In order to increase the perception of directional orientation, the contacting surface 138 of the probe 140 may be provided with a row of contacts 150 connected together to form a shorting bar. The direction of greatest signal intensity will then be from the side of the spaced contacts 142, 144 opposite that of the shorting bar 150.

Thus, the signal processing system of the present invention provides a means for perceptually changing the listening position within the audio signal space 28 by manually adjusting a spatial position control 12 so that a directional movement of the control causes a corresponding perceptual directional change in listening position.

While two presently preferred embodiments of the invention have been described in detail, it will be appreciated that many variations of the basic signal processing system are possible without departing from the spirit and scope of the present invention. Therefore, the scope of the invention is not to be limited except as by the following claims.

I claim:

1. An audio signal processing system for processing audio signals within an audio signal space, comprising:

a plurality of audio transducers positioned at a plurality of different locations in said audio signal space, said transducer generating a plurality of independent electrical channel signals;

electrical circuit means connected to said plurality of electrical channel signals for substantially producing an electrical circuit analog of said audio signals space, said circuit means including potentiometers which are series ring connected, with each channel signal being connected to a junction between two of said potentiometers, said channel signals being thereby distributed in proportions substantially corresponding to the location of said audio transducers in said audio signal spaces;

electrical connection means connected to said electrical circuit means at the wiper terminals of said potentiometers to generate two binaural output signals having signal intensities from each of said electrical signals;

position control means connected to said circuit means and said connection means to selectively vary the positions of said wiper terminals to correspondingly vary said channel signal intensities of said binaural output signals whereby the binaural perception of spacial position of a person listening to said binaural signals may be varied, said position control means having a manually operable control device to said wiper terminals of said potentiometers for dependent movement therewith, physical movement of said control device substantially corresponding to perceived directional movement of the spacial position of a person listening to said binaural signals; and orientation means for selectively connecting together combinations of said wiper terminals to provide said binaural signals, whereby in the perception of orientation in said audio signal space of a person listening to said binaural signals may be varied.

2. The signal processing system defined in claim 1 wherein said orientation means includes:

a rotary switch operatively connected to said control device.

3. An audio signal processing system for processing audio signals within an audio signal space comprising:

four audio transducers positioned at substantially equally spaced locations around said audio signal space, said audio transducers generating four independent electrical channel signals;

recording means for simultaneously recording said four independent channel signals;

playback means for reproducing said four independent channel signals;

circuit means connected to said playback means for substantially producing an electrical circuit analog of said audio signal space, said circuit means having four series ring connected potentiometers with a channel connected to each junction of two potentiometers, each of said potentiometers having a mechanically variable wiper terminal;

combining means for combining predetermined pairs of said wiper terminals into first and second binaural electrical output signals having signal intensities from each of said channel signals;

binaural transducer means for converting said binaural electrical output signals into audible binaural sounds; and manual position control means connected to said mechanically variable wiper terminals of said potentiometers for dependent movement thereof to selectively vary said channel signal intensities of said binaural electrical output signals, whereby directional manipulation of said position control means results in a substantially corresponding directional change in the binaural perception of spatial position within said audio signal space.

4. The signal processing system defined in claim 3 wherein:

said combining means includes an orientation switch for selecting a plurality of different paired combinations of said wiper terminals, whereby the binaural perception of orientation may be varied within said audio signal space.

5. An audio signal processing system for processing audio signals within an audio signal space comprising:

four audio transducers positioned in substantially equally spaced locations around said audio signal space, said audio transducers generating four independent electrical channel signals;

recording means for simultaneously recording said four independent channel signals;

playback means for reproducing said four independent channel signals;

circuit means connected to said playback means for substantially producing an electrical circuit analog of said audio signal space, said circuit means having a flat surface with uniform resistance characteristics and shaped substantially the same as said audio signal space, said channel signals being connected to points around the edge of said resistive surface substantially corresponding to the respective locations of said audio transducers around said audio signal space;

pickup means having a pair of spaced contacts for contacting said resistive surface, the signals on said contact being binaural output signals, said pickup means being movable across said resistive surface, whereby directional manipulation of said pickup means results in a substantially corresponding directional change in the binaural perception of spatial position within said audio signal space.

6. An audio signal processing system comprising:

four audio transducers positioned in substantially equally spaced locations around an audio signal space, said audio transducers generating four independent electrical channel signals;

recording means for simultaneously recording said four independent electrical channel signals;

playback means for reproducing said four independent electrical channel signals;

circuit means connected to said playback means for substantially producing an electrical circuit analog of said audio signal space, said circuit means having a flat surface with uniform resistance characteristics and shaped substantially the same as said audio signal space, said channel signals being connected to points around the edge of said resistive surface substantially corresponding to the respective locations of said audio transducers around said audio signal space;

pickup means having a pair of spaced contacts for contacting said resistive surface, the signals on said contacts being binaural output signals, said pickup means being movable across said resistive surface, wherein directional manipulation of said pickup means results in a substantially corresponding directional change in the binaural perception of spatial position within said audio signal space and the binaural perception of orientation within said audio signal space may be changed by rotating the position of said contacts with respect to said resistive surface.

7. For use in a multi-channel recording system in which a plurality of independent recorder channel signals from a plurality of audio transducers positioned around an audio signal space are available as electrical channel signal outputs, an audio signal processing system comprising:

electrical circuit means connected to said plurality of channel signal outputs for substantially producing an electrical circuit analog of said audio signal space, said electrical circuit means including an electrical resistance element connected to said channel output signals for distributing said output channel signals in said element in proportions substantially corresponding to the location of said audio transducers in said audio signal space, said electrical resistance element being a flat surface having uniform resistance characteristics, said channel output signals being connected to spaced points around the edge of said resistance surface; and electrical connection means connected to said electrical circuit means at selected terminal positions to generate two electrical output signals having signal intensities from each of said channel signal outputs, said electrical connection means including a pair of spaced contacts for contacting said resistance surface, the signals appearing at said contacts being binaural output signals, said connection means being movable across said surface producing substantially corresponding perceptions of directional movement of the listening point within said audio signal space.

audio transducer means connected to said connection means for converting said two output signals to binaural signals; and position control means connected to said circuit means and said connection means to selectively vary said terminal positions to correspondingly vary said channel signal intensities of said electrical output signals, whereby the binaural perception of spatial position of a person listening to said binaural signals may be varied.

8. An audio signal processing system for processing audio signals within an audio signal space, comprising:

a plurality of audio transducers positioned at a plurality of different locations in said audio signal space, said transducers generating a plurality of independent electrical channel signals;

a flat surface having uniform electrical resistance characteristics connected to receive said plurality of electrical channel signals at spaced points around said resistance surface for substantially producing an electrical circuit analog of said audio signal space;

electrical connection means including a pair of taps positioned at any point on said resistive surface for tapping said channel signals to thereby generate two binaural output signals having signal intensities from each of said electrical channel signals; and position control means connected to said flat surface and to said connection means to selectively vary said tap positions to correspondingly vary said channel signal intensities of said binaural output signals, whereby the binaural perception of spatial position of a person listening to said binaural signals may be varied.

* * * * *